US006823608B1

(12) United States Patent
Shea, Jr.

(10) Patent No.: US 6,823,608 B1
(45) Date of Patent: Nov. 30, 2004

(54) APPARATUS AND METHOD FOR DRYING AN AUTOMOBILE CHASSIS

(75) Inventor: James J. Shea, Jr., Killingworth, CT (US)

(73) Assignee: Classic Air Systems, LLC, Westbrook, CT (US)

( * ) Notice: Subject to any disclaimer, the term of this patent is extended or adjusted under 35 U.S.C. 154(b) by 0 days.

(21) Appl. No.: 10/300,956

(22) Filed: Nov. 20, 2002

(51) Int. Cl.[7] ..... F26B 19/00
(52) U.S. Cl. ..... 34/666; 34/232; 34/509
(58) Field of Search ..... 34/666, 218, 232, 34/467, 487, 509; 432/9, 128

(56) References Cited

U.S. PATENT DOCUMENTS 3,590,417 A * 7/1971 Emanuel ..... 15/302
3,984,921 A * 10/1976 Adams ..... 34/666
4,476,269 A 10/1984 Wilk et al.
5,407,549 A 4/1995 Camp
5,875,565 A * 3/1999 Bowman ..... 34/666
5,901,461 A * 5/1999 McElroy et al. ..... 34/233
5,950,331 A * 9/1999 Coggins et al. ..... 34/666
5,960,564 A * 10/1999 McElroy et al. ..... 34/666
6,062,850 A * 5/2000 Ino et al. ..... 432/143

* cited by examiner

*Primary Examiner*—Ira S. Lazarus
*Assistant Examiner*—Kathryn S. O'Malley
(74) *Attorney, Agent, or Firm*—DeLio & Peterson, LLC

(57) ABSTRACT

An apparatus and method for inhibiting corrosion of an automobile chassis is provided. The method utilizes an apparatus which provides a flow of heated air to the underside of the automobile. The apparatus preferably includes a pair of elongated conduits positioned under and along the length of the automobile having a plurality of spaced apart openings. A flow of heated air from the apparatus housing is directed into the conduits and flows out of the openings outward and upward toward the chassis of the automobile and dries the chassis.

14 Claims, 7 Drawing Sheets

APPARATUS AND METHOD FOR DRYING AN AUTOMOBILE CHASSIS

BACKGROUND OF THE INVENTION

1. Field of the Invention

The present invention relates to automobile corrosion and, in particular, to a method and apparatus for protecting against corrosion of the automobile and, in particular, the chassis of the automobile.

2. Description of Related Art

Metals, such as steel, are subject to corrosion which is a serious problem for many steel containing products including automobiles. The following description will be directed to automobiles for convenience but it will be appreciated by those skilled in the art that the apparatus and method of the invention may be used for other such applications.

Automobiles are generally made from a steel chassis body and have protective multilayer coatings of paint on the exterior surfaces. The underside chassis of the automobile is essentially unprotected however, and exposed steel is subject to corrosion because of rain and other elements such as salt, which contact the underside of the automobile during use of the automobile.

Corrosion also occurs when an automobile is standing especially for a period of time, such as in a garage, where moisture accumulates on the chassis due to dampness. This is particularly a problem for antique or classic cars which are not driven frequently and are usually stored for a long period of time before being used such as in a car show or parade.

Corrosion is a process which occurs on the surface of steel or other metal part of an automobile when exposed to an electrolyte such as water. When the water comes in contact with the steel a small amount of the iron is dissolved and the oxygen in the water combines with the iron in the steel establishing a miniature electrochemical circuit. This circuit causes the steel to deteriorate resulting in corrosion and pitting.

Automobile manufacturers have combated corrosion in a number of ways including protective chemical barriers such as paint and other undercoating materials and also the use of cathodic protection systems which inhibit corrosion by impressing a reverse current at the point of corrosion.

Bearing in mind the problems and deficiencies of the prior art, it is therefore an object of the present invention to provide an apparatus for inhibiting corrosion of an automobile chassis.

It is another object of the present invention to provide a method for inhibiting corrosion of an automobile chassis.

Still other objects and advantages of the invention will in part be obvious and will in part be apparent from the following specification.

SUMMARY OF THE INVENTION

The above and other objects, which will be apparent to those skilled in art, are achieved in the present invention which is directed to, in a first aspect, an apparatus for inhibiting corrosion of an automobile chassis comprising:

- a fan having an air input and an air output providing a flow of air;
- a heater for heating the flow of air; and
- conduit means for directing the flow of heated air to the underside of an automobile and preferably along the length of the automobile.

In another aspect of the invention, a method is provided for inhibiting corrosion of an automobile chassis comprising the steps of:

- providing an automobile to be protected against corrosion;
- providing an apparatus comprising:
  - a fan having an air input and an air output providing a flow of air;
  - a heater for heating the flow of air; and
  - conduit means for directing the flow of heated air to the underside of the automobile and preferably along the length of the automobile; and
- activating the apparatus directing the flow of heated air through the conduit to the underside of the automobile.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiments of the present invention, reference will be made herein to FIGS. 1–10 of the drawings in which like numerals refer to like features of the invention.

Figure 1:
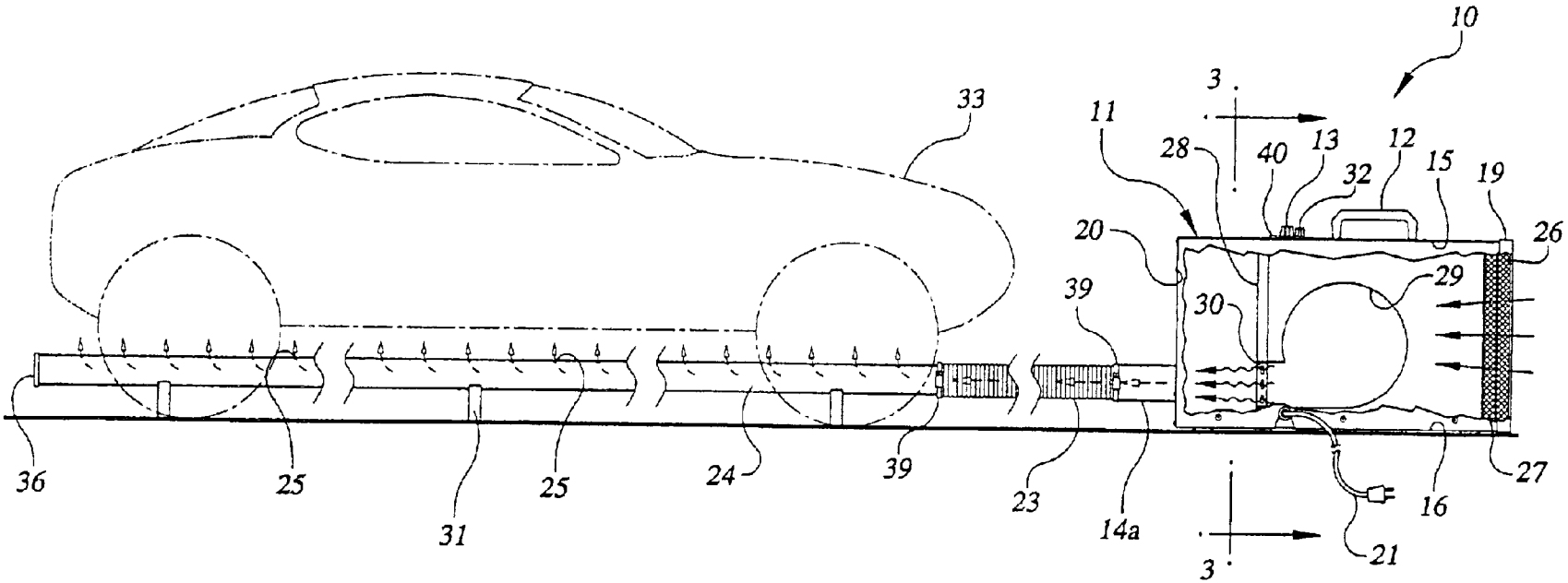
FIG. 1 is a cut-away elevational view of an apparatus of the invention positioned to direct a flow of heated air to the underside of an automobile.

Referring to FIG. 1, this figure shows a cut-away view of the right side of the apparatus 10. The housing shown generally as numeral 11 has a top surface 15, a bottom surface 16, a back 19, and a front 20. A pre-filter 26 and a post-filter 27 are positioned at the back of the apparatus so that air entering the housing 11 as shown by the arrows passing through the two filters 26 and 27 is filtered. A support bracket 28 extending around the housing periphery is shown supporting a fan 29 and a heating element 30. The cord 21 provides the electrical power for the fan 29 and heating element 30. Conduit 14*a* (14*b* not shown) is shown extending outward from the front 20 of the housing 11. A flexible hose 23 is attached by attachment means 39 such as worm-drive hose clamps to the end of the conduit port 14*a* and a pipe 24 is shown connected to the open end of the flexible hose 23. Any suitable clamp can be used. Pipe supports 31 are shown supporting the pipe 24 above the ground level on which the housing 11 is typically placed. A cap 36 closes the open end of pipe 24.

A timer 13, fuse holder 32, indicator light 40 and handle 12 are shown on the top surface 15 of the housing 11.

An automobile 33 is shown in phantom positioned over the pipe 24 and facing housing 11 so that heated air exiting the openings 25 is directed upward to the underside of the automobile 33 as shown by the arrows. This warm air prevents moisture buildup on the underside of the automobile 33 and inhibits corrosion of the chassis and other exposed metal parts. The air also warms the underside of the automobile 33 so that the interior of the automobile is heated which further minimizes damage due to moist air in a confined area which can cause mildew and other such problems in the interior of the automobile.

The fan 29 is a conventional fan having an air inlet and an air outlet as will be appreciated by those skilled in the art. Likewise, heating element 30 is a conventional resistant-type element which is heated when a current flows through the element. Any type fan and heating element may be used. Thus, filtered air entering fan 29 and then exiting the fan over heating element 30 will be heated and will exit the housing 11 through conduits 14*a* and 14*b* (14*b* not shown) and enter pipes 24 as shown in the figures below. Typically, the fan 29 and heating element 30 are sized to provide a steady flow of air which is preferably warmed to a temperature above room temperature, preferably about 80° F. to about 115° F., and most preferably about 98° F. to 110° F. The air flow output of the fan can vary widely and is typically up to about 100 cubic feet per minute (CFM), preferably about 2040 CFM. An air flow of about 34 CFM at 110° F. has been found to provide excellent corrosion inhibiting results. Average discharge velocity through each of the pipe openings can also vary widely and is typically up to about 2300 feet per minute (FPM), or more, preferably about 1500 to 1700 FPM.

Regarding the filters 26 and 27, any suitable filter may be used, typically a fiberglass filter such as those used in an air conditioner and other such devices. The filters will be changed periodically as known in the art.

Figure 2:
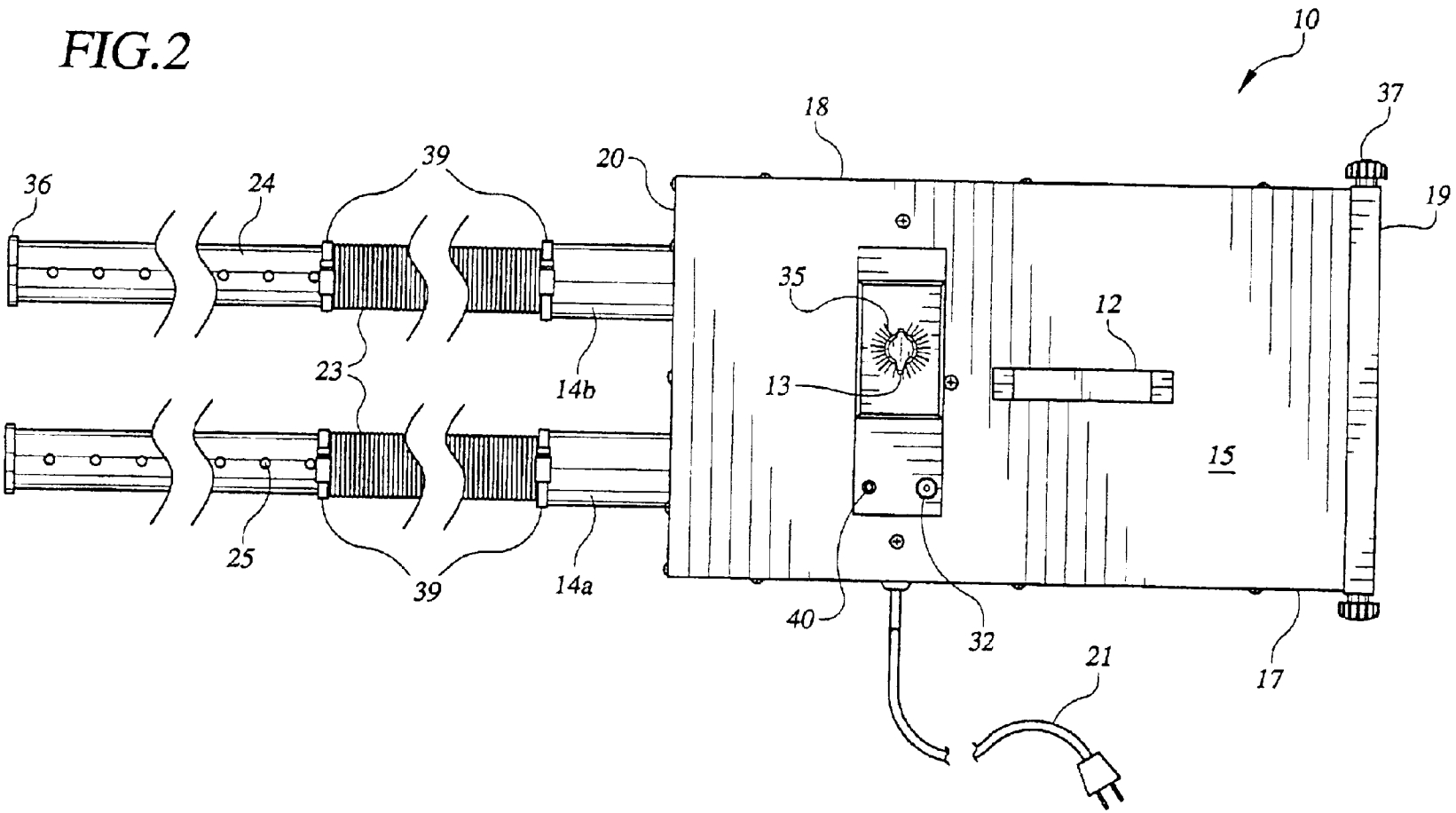
FIG. 2 is a plan view of the apparatus of FIG. 1.

Referring now to FIG. 2, a plan view of FIG. 1 is shown where the apparatus 10 is shown having a handle 12, timer device 13 and timer settings 35, fuse holder 32 and on/off indicator light 40 on the upper surface 15 of the housing 11. Outlet ports 14*a* and 14*b* are shown extending from the front surface 20 of the housing 11. Flexible hoses 23 connect the output ports 14*a* and 14*b* to pipes 24 and are secured to the ports and pipes by clamps 39. As can be seen, the openings 25 in pipes 24 are spaced apart (usually about 5 to 7 inch apart and preferably 6 to 6¼ inch apart) and are preferably in a straight line and positioned so that the air flowing through the pipes 24 is directed upward to the underside of the automobile 33 which is positioned over the pipes 24. The pipe is typically 1.5 inch diameter PVC by 10 feet long and divided into two (2) or more sections for ease of packaging and storage. A couple is used to connect the pipe sections. The openings are about 0.375 inch in diameter and are spaced apart so that a total of 20 holes are provided in each pipe section. The opening diameter and spacing can vary widely as will be appreciated by those skilled in the art. Further additional output ports can be employed but (2) have been found to be adequate.

Figure 3:
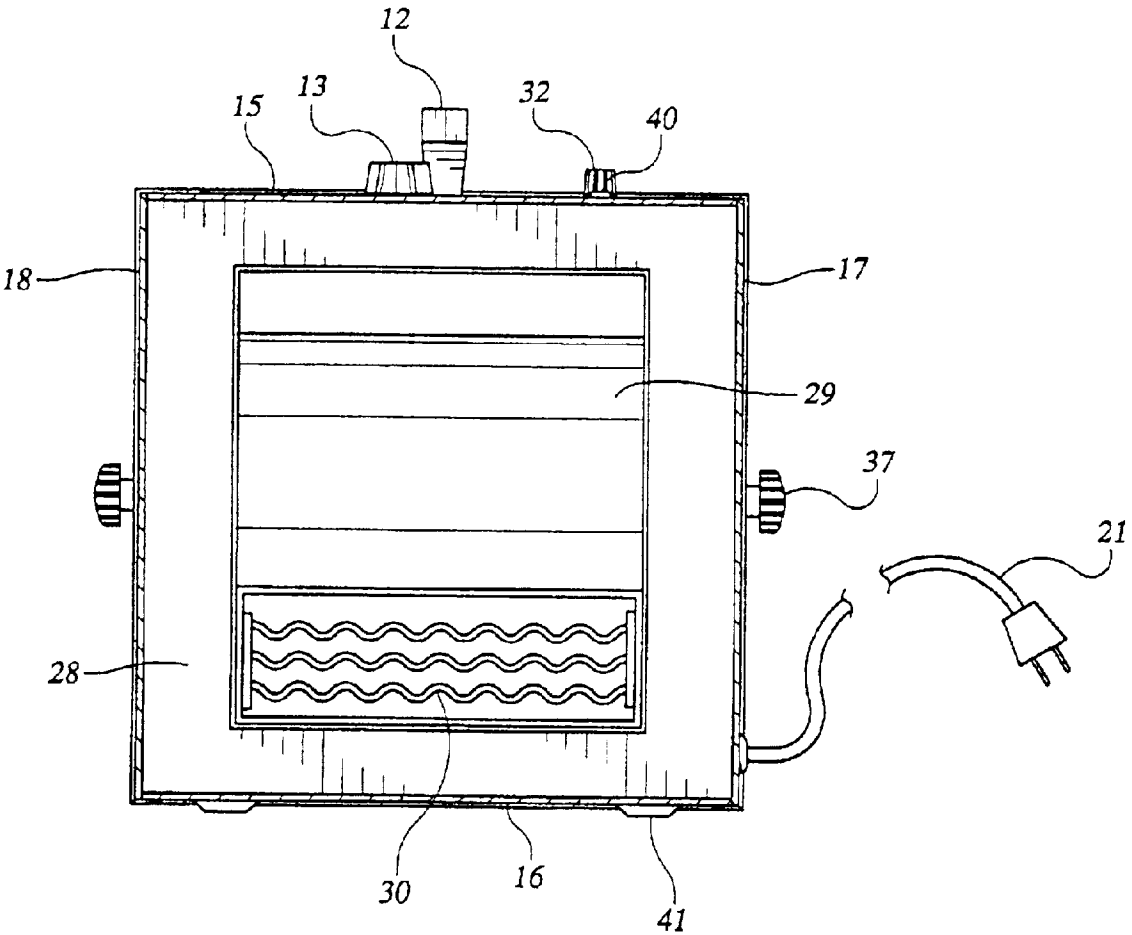
FIG. 3 is a cross-sectional view of the apparatus of FIG. 1 taken along line 3—3.

Referring now to FIG. 3, a cut-away view of the front end 20 of the housing 11 is shown. The housing 11 is shown having an upper surface 15, a bottom surface 16 with support dimples 41, a right side 17, and a left side 18. The support bracket 28 extends around the periphery of the housing 11 and is open in the middle and is used to support the heating element 30 and the fan 29. Electrical cord 21 is shown extending from the right side 17 of the housing 11.

In operation, the apparatus 10 is positioned on the ground at the rear or front of an automobile so that the output ports 14*a* and 14*b* are directed towards the automobile 33. The flexible hoses 23 and conduit pipes 24 are connected and secured to the output ports secured thereto and positioned under the automobile. The openings 25 in conduit pipes 24 are preferably positioned so that they are facing the underside of the automobile 33. The cord 21 is then plugged in an electrical source (conventional 120V AC circuit) and the timer 13 activated for the desired lime to provide a flow of heated air to the underside of the automobile. When the timer 13 is activated, heating element 30 and fan 29 are both turned on. Air is sucked into the housing 11 through filters 26 and 27, passes through the fan 29 and the air flow output from the fan 29 is heated by heating element 30. The heated air is forced out the output ports 14*a* and 14*b* into conduit pipes 24. After the desired period of time has expired, the timer 13 shuts off and the heating element 30 and fan 29 are deactivated and the flow of heated air stops.

It is preferred that the apparatus be operated at least once a day for about one hour, or more, since this has been found to inhibit corrosion of the automobile under normal storing conditions such as in an unheated garage. The length of time the apparatus can be activated will vary widely depending on each particular use. Other modifications of the apparatus for particular storage conditions to inhibit corrosion of the automobile chassis will be appreciated by those skilled in the art.

Figure 4:
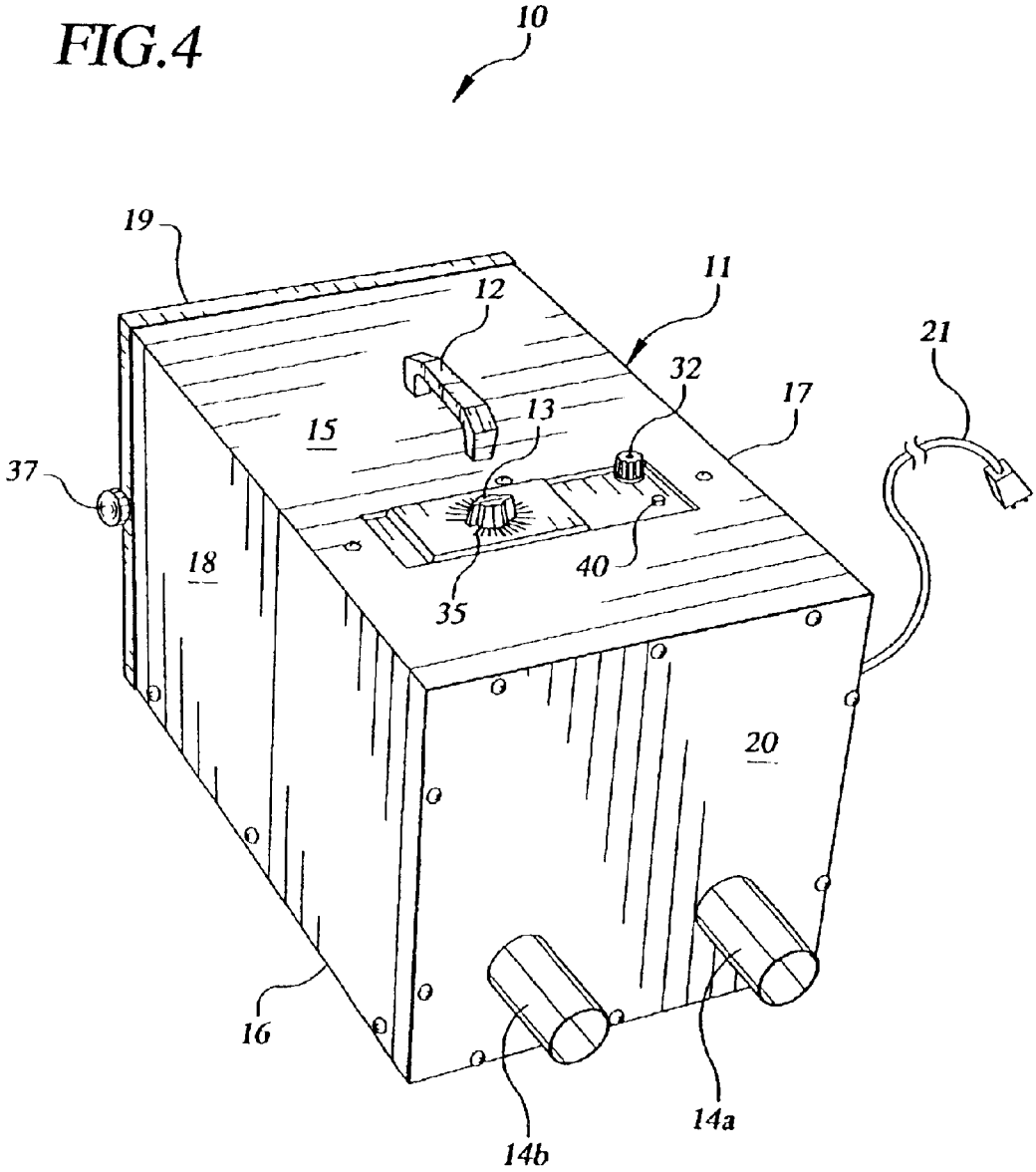
FIG. 4 is a perspective view of the apparatus of FIG. 1.

Referring now to FIG. 4, an apparatus of the invention is shown in perspective generally as 10. The apparatus 10 comprises a housing shown generally as 11 having a handle 12 on the top surface 15. Also on the top surface 15 are shown a timer 13 with timer settings 35, indicator light 40 and a fuse holder 32. The housing 11 has a bottom surface 16, a right side surface 17, and a left side surface 18. The housing 111 has a back 19 and a front 20. On the front surface 20 of the housing 11 are two (2) outflow conduit ports 14*a* and 14*b*. In operation, warm air will be forced from the interior of the housing 11 through the ports 14*a* and 14*b* and into flexible hoses 23 and conduit pipes 24 attached thereto as shown above. Openings 25 in the pipes 24 allow heated air to exit the pipes and form a warm air current which is directed upward at the underside of an automobile. An electrical connection cord is shown as 21.

Figure 5:
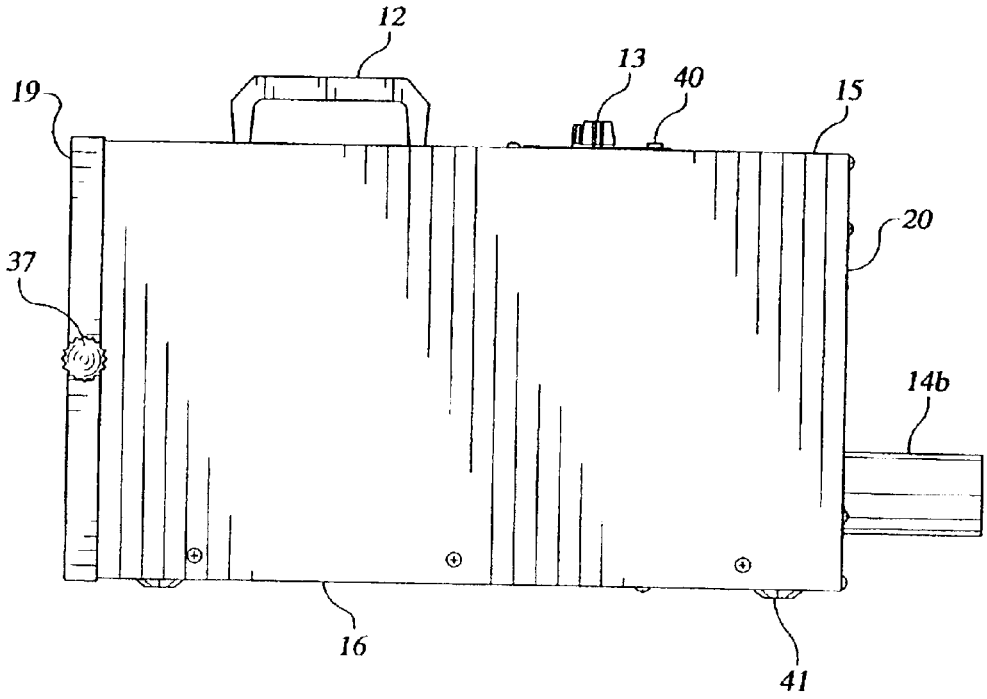
FIG. 5 is a left side elevational view of the apparatus of FIG. 4.

FIG. 5 shows an elevational view of the left side of the apparatus of FIG. 4.

Figure 6:
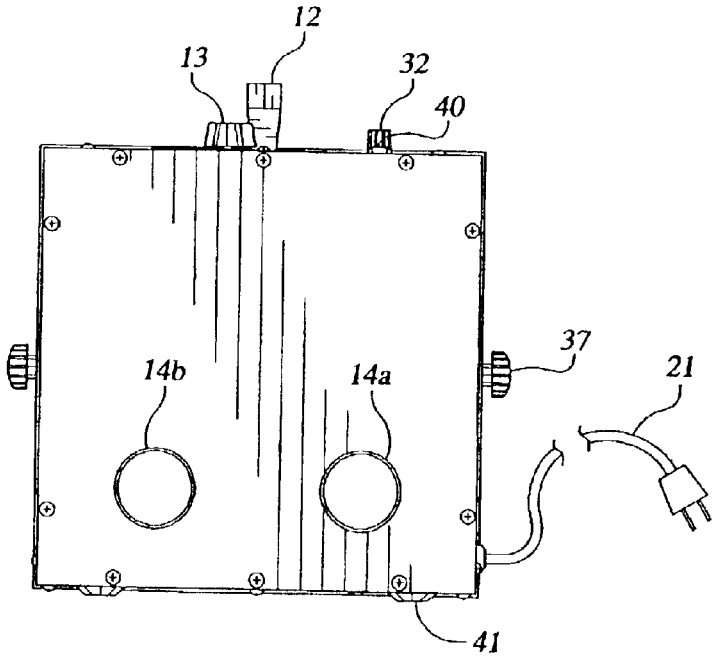
FIG. 6 is a front view of the apparatus of FIG. 4.

FIG. 6 shows the front view of the apparatus of FIG. 4.

Figure 7:
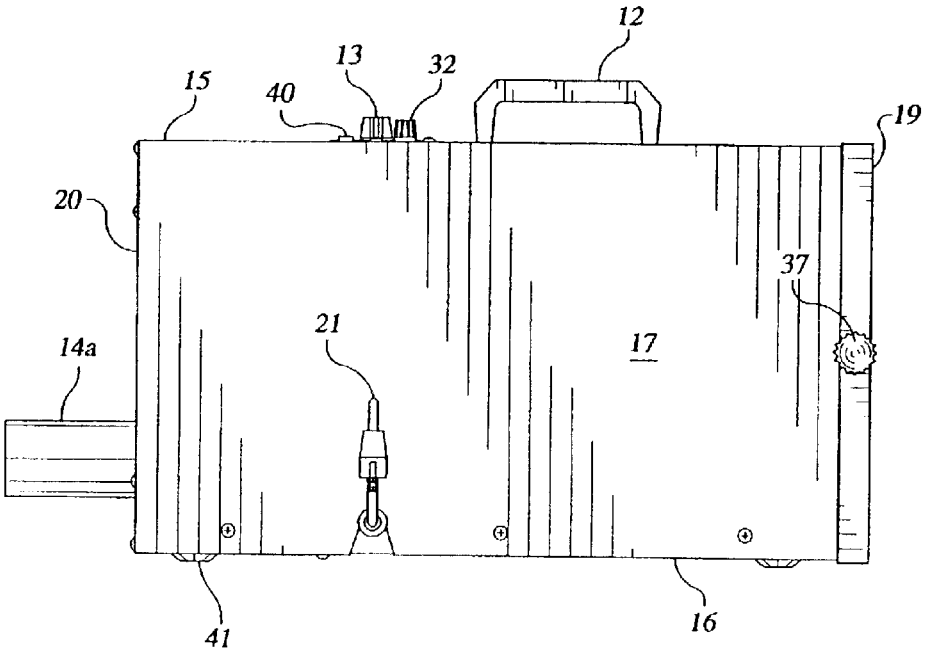
FIG. 7 is a right side elevational view of the apparatus of FIG. 4.

FIG. 7 shows an elevational view of the right side of the apparatus of FIG. 4.

Figure 8:
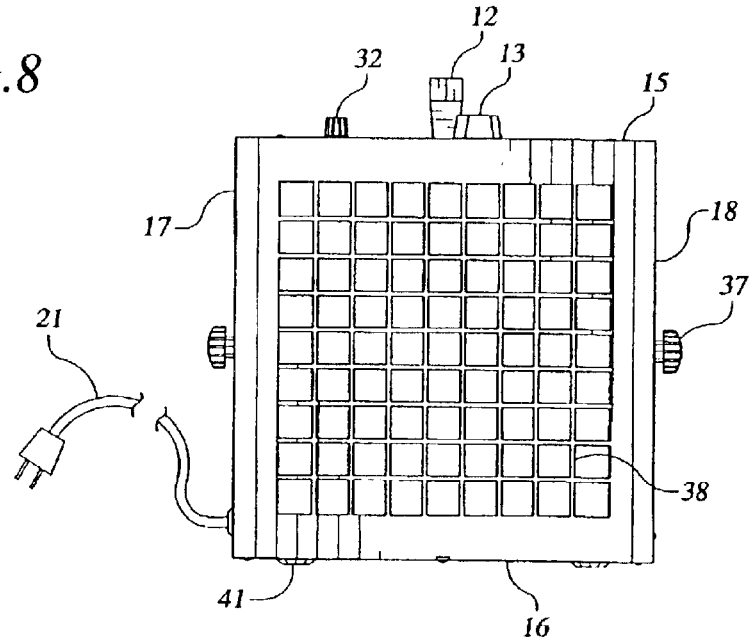
FIG. 8 is a back view of the apparatus of FIG. 4.

FIG. 8 is a back view of the apparatus of FIG. 4.

Figure 9:
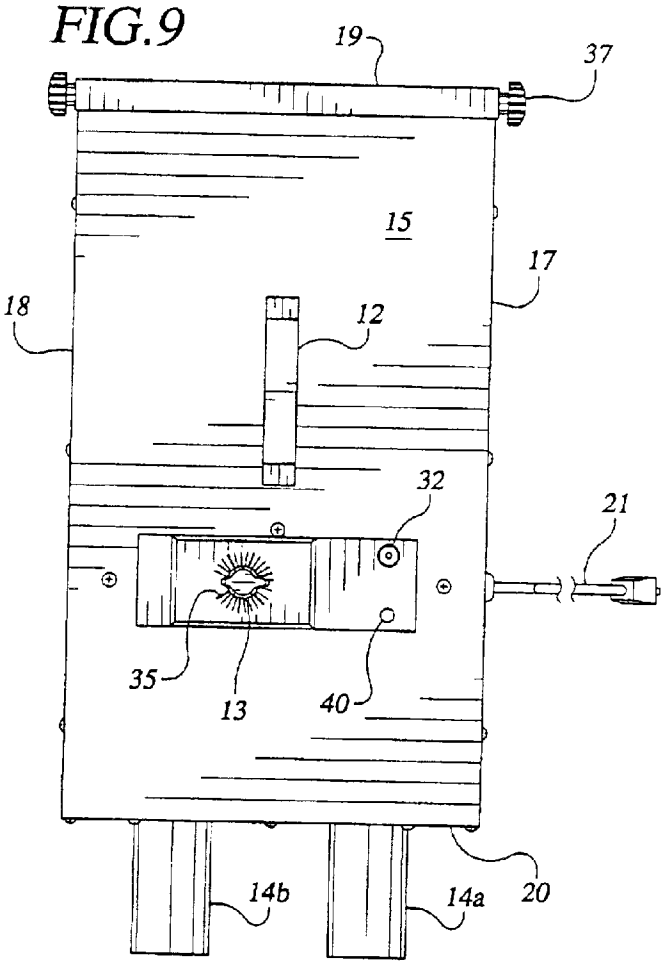
FIG. 9 is a plan view of the apparatus of FIG. 4.

FIG. 9 shows a plan view of the apparatus of FIG. 4.

Figure 10:
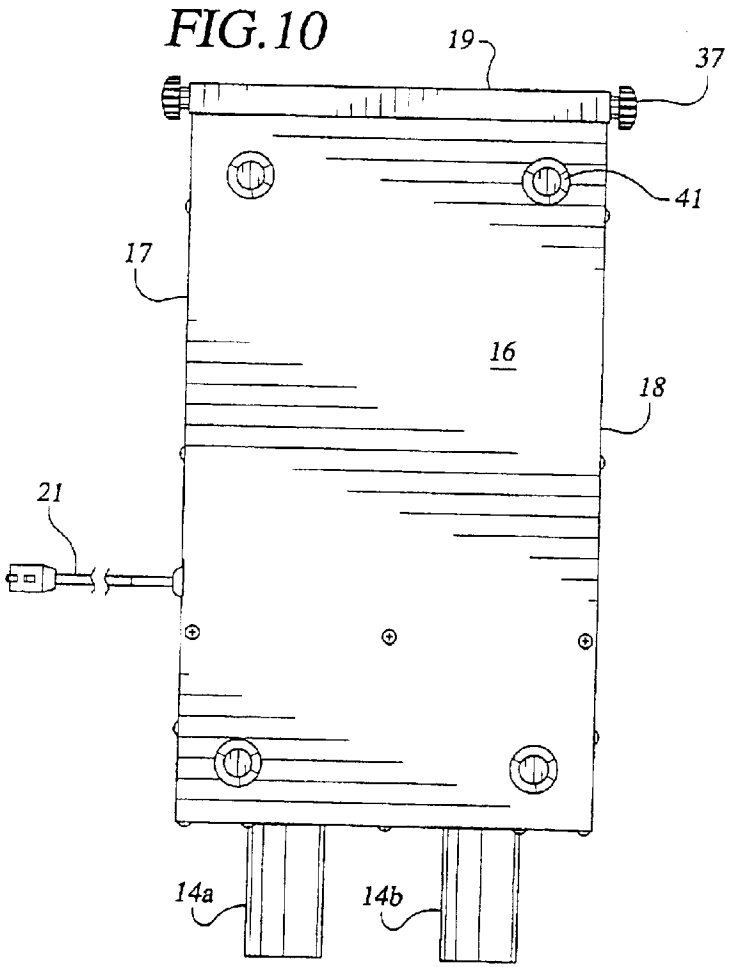
FIG. 10 is a bottom view of the apparatus of FIG. 4.

FIG. 10 is a bottom view of the apparatus of FIG. 4.

In operation, the timer 13 would be turned to the desired time setting on dial 35 and activates the fan and heater elements to form a current of warm air discussed above. The fuse holder 32 holds a fuse which protects against electrical malfunction.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A device movable by a person so that the device can be moved to a position on the ground adjacent an automobile at rest for inhibiting corrosion of an automobile chassis when both the device and the automobile are at rest comprising:

a housing having an air input and an air output and a fan therein for providing a flow of air from the air input to the air output in an amount up to about 100 cubic feet per minute;

a heater for heating the flow of air;

an electrical power cord for supplying conventional 102V AC circuit electricity to the fan and heater; and conduit means connected to the air output having a plurality of openings therein and which conduit means is positioned under an automobile at rest for directing the flow of air to the underside of the automobile through the openings; wherein the air output comprises two ports and the conduit means comprises two elongated pipes having spaced openings therein with each pipe connected to a separate air output port, which pipes are positioned under the automobile and along the length of the automobiles.

2. The apparatus of claim 1 wherein the apparatus further comprises a flexible hose connected to each outlet port and pipe to enable the pipes to be moveably positioned under the automobile.

3. The apparatus of claim 2 further comprising a timer to control the fan and heater.

4. The apparatus of claim 1 further comprising a timer to control the fan and heater.

5. The apparatus of claim 1 wherein the heater heats the flow of air to a temperature up to 115° F.

6. The apparatus of claim 5 wherein the fan provides a flow of heated air directed to the underside of the automobile from the openings at about 20–40 cubic feet per minute.

7. The apparatus of claim 6 wherein the fan provides an average discharge velocity of heated air through each of the openings at up to about 2300 feet per minute.

8. A method for inhibiting corrosion of an automobile chassis when the automobile is at rest comprising the steps of:

providing an automobile at rest to be protected against corrosion;

providing a device movable by a person so that the device can be moved to a position on the ground adjacent the automobile comprising:

a housing having an air input and an air output and a fan therein for providing a flow of air from the air input to the air output in an amount up to about 100 cubic feet per minute;

a heater for heating the flow of air;

an electrical power cord for supplying conventional 120V circuit electricity to the fan and heater; and conduit means connected to the air output having a plurality of openings therein;

positioning the conduit means under the automobile; and activating the apparatus directing the flow of air through the openings in the conduit to the underside of the automobile; wherein the air output comprises two ports and the conduit means comprises two elongated pipes having spaced opening therein with each pipe connected to a separate air output port, which pipes are positioned under the automobile and along the length of the automobile.

9. The method of claim 8 wherein the method further comprises providing a flexible hose connected to each outlet port and pipe to enable the pipes to be moveably positioned under the automobile.

10. The method of claim 9 wherein the apparatus is activated using a timer.

11. The method of claim 8 wherein the apparatus is activated using a timer.

12. The method of claim 8 wherein the heater heats the flow of air to a temperature up to 115° F.

13. The method of claim 12 wherein the fan provides a flow of heated air directed to the underside of the automobile from the openings at about 20–40 cubic feet per minute.

14. The method of claim 13 wherein the fan provides an average discharge velocity of heated air through each of the openings at up to about 2300 feet per minute.

* * * * *